US012369761B2

(12) United States Patent
Dorra

(10) Patent No.: US 12,369,761 B2
(45) Date of Patent: Jul. 29, 2025

(54) TOILET SEAT ASSEMBLY

(71) Applicant: SANEEX LLC, North Miami Beach, FL (US)

(72) Inventor: Nuri Dorra, North Miami Beach, FL (US)

(73) Assignee: SANEEX LLC, North Miami Beach, FL (US)

( * ) Notice: Subject to any disclaimer, the term of this patent is extended or adjusted under 35 U.S.C. 154(b) by 0 days.

(21) Appl. No.: 17/778,572

(22) PCT Filed: Jan. 10, 2022

(86) PCT No.: PCT/US2022/011818

§ 371 (c)(1),
(2) Date: May 20, 2022

(87) PCT Pub. No.: WO2022/150703

PCT Pub. Date: Jul. 14, 2022

(65) Prior Publication Data

US 2023/0144681 A1 May 11, 2023

Related U.S. Application Data

(60) Provisional application No. 63/212,720, filed on Jun. 20, 2021, provisional application No. 63/135,555, filed on Jan. 8, 2021.

(51) Int. Cl.
*A47K 13/30* (2006.01)
*E03D 9/00* (2006.01)

(52) U.S. Cl.
CPC ..... *A47K 13/302* (2013.01); *E03D 9/005* (2013.01); *E03D 9/007* (2013.01); *E03D 9/002* (2013.01)

(58) Field of Classification Search
CPC ..... A47K 13/12; A47K 13/26; A47K 13/302; E03D 5/105; E03D 9/002; E03D 9/04–052; B05B 17/0646
See application file for complete search history.

(56) References Cited

U.S. PATENT DOCUMENTS 7,028,346 B2 * 4/2006 Ermini ..... A47K 13/302 4/DIG. 6
8,060,953 B1 * 11/2011 Dorra ..... A47K 13/302 4/444

(Continued)

FOREIGN PATENT DOCUMENTS

CN 109113147 A 1/2019
CN 210164009 U 3/2020

(Continued)

*Primary Examiner* — David P Angwin
*Assistant Examiner* — Nicholas A Ros
(74) *Attorney, Agent, or Firm* — Dinsmore & Shohl LLP

(57) ABSTRACT

Among others, the present invention provides toilet seat assemblies for cleaning, disinfecting, and/or sanitizing toilet seat, each including a base configured to be secured to the top surface of the toilet bowl; a toilet seat attached to the base and movable between an open position and a closed position; and a cover attached to the base and movable between an open position and a closed position. The toilet seat assembly may include a liquid discharge and disperse means, which further includes one or more liquid discharge apertures for discharging a liquid, particularly with an atomizer for spraying the mist, and one or more gas discharge apertures for facilitating dispersal of the liquid, thereby enabling the liquid to contact, clean, disinfect and/or sanitize the toilet seat.

28 Claims, 10 Drawing Sheets

(56) References Cited

U.S. PATENT DOCUMENTS

Figure 1:
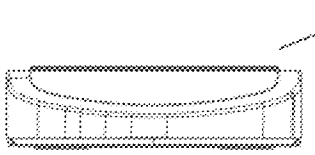

| | | | | |
|---|---|---|---|---|
| 9,635,989 | B2 * | 5/2017 | Mantel | A47K 13/26 |
| 9,828,755 | B1 * | 11/2017 | Clements | E03D 9/08 |
| 10,299,640 | B2 * | 5/2019 | Rokuta | E03D 11/13 |
| 10,385,560 | B2 * | 8/2019 | Shen | B65F 7/005 |
| 10,584,469 | B2 * | 3/2020 | Nogoshi | E03D 9/08 |
| 11,419,464 | B2 * | 8/2022 | Thorne | E03D 9/005 |
| 2013/0026250 | A1 * | 1/2013 | Burt | B05B 17/0615 239/302 |
| 2014/0373263 | A1 * | 12/2014 | Plate | E03D 9/00 4/300 |
| 2018/0165417 | A1 * | 6/2018 | Hall | A61B 5/6891 |
| 2021/0369881 | A1 * | 12/2021 | Hayden | A61L 2/24 |
| 2023/0069531 | A1 * | 3/2023 | Chen | A47K 13/302 |

FOREIGN PATENT DOCUMENTS

| | | | | |
|---|---|---|---|---|
| JP | 205192995 | * | 7/2005 | E03D 9/08 |
| JP | 2005192995 | * | 7/2005 | E03D 9/08 |
| JP | 2015-158103 A | | 9/2015 | |
| KR | 20120053814 | * | 5/2012 | A47K 13/10 |
| KR | 20140045757 | * | 4/2014 | E03D 9/08 |
| WO | WO2005012627 | * | 2/2005 | B05B 5/03 |
| WO | WO2008058941 | * | 5/2008 | B05B 17/0646 |

* cited by examiner

TOILET SEAT ASSEMBLY

FIELD OF THE INVENTION

This application is the national phase of PCT Application No. PCT/US2022/011818, filed on Jan. 10, 2022, which claims priority to U.S. Provisional Application No. 63/212,720, filed on Jun. 20, 2021 and U.S. Provisional Application No. 63/135,555, filed on Jan. 8, 2021, the contents of all of which are incorporated herein by reference in their entirety. The present invention relates to toilet seat cleaning, disinfecting, sterilizing, and/or sanitizing systems, and more particularly, to an assembly for automatically cleaning, disinfecting, sterilizing, and/or sanitizing a toilet seat.

BACKGROUND OF THE INVENTION

There are many other known toilet seat washing assemblies. Most of these assemblies employ the use of numerous components in order to function properly. These numerous components require a great deal of user time spent in maintenance and installation. Moreover, many of these assemblies have components that rotate and move when in operation such that they are more susceptible to failure. Not only are these assemblies more susceptible to failure, they are also more expensive and difficult to manipulate for precise control of the assembly during the cleaning process. For example, some known assemblies have rotating arms that clean the toilet seat but these arms are not able to be controlled or optimized to produce various cleaning cycles desirable for a particular user. The use of additional components by these known assemblies also make them generally expensive for most users and/or other consumers, and require more time/cost to install and to maintain.

Additionally, many known toilet seat cleaning assemblies are not capable of, or are not configured properly to, effectively and efficiently clean and/or sanitize toilet seats that are completely circular. Specifically, some known toilet seat cleaning assemblies are designed to sequential emit a cleaning solution around a toilet seat that is then designed to run off into the toilet bowl. These systems, however, often leave residue from the cleaning solution and/or require the emission of significant amounts of fluid. As such, the toilet seat is disadvantageously not immediately ready for use by the user and/or is not economical. Additionally, many known toilet seat cleaning assemblies are designed to work solely with one type of (e.g., u-shaped) toilet seats, thereby making said assemblies ineffective or impracticable for use with other types (e.g., circular) toilet seats.

To overcome these drawbacks, it is therefore desired to have an improved toilet seat assembly capable of automatically, effectively and efficiently cleaning, disinfecting, sterilizing, and/or sanitizing toilet seats.

SUMMARY OF THE INVENTION

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

The present invention generally relates to an improved toilet seat assembly capable of automatically, effectively and efficiently cleaning, disinfecting, sterilizing, and/or sanitizing toilet seats. In particular, the toilet seat assembly according to the present invention is capable of reducing (or even destroying) microbial activity or microorganisms on a surface of the toilet, thereby performing an effective disinfecting, sterilizing, or sanitizing function.

One aspect of the present invention provides a toilet seat assembly for a toilet having a toilet bowl with a top surface, the toilet seat assembly comprising: a base configured to be secured to the top surface of the toilet bowl; a toilet seat attached to the base and movable between an open position and a closed position; and a cover attached to the base and movable between an open position and a closed position. The cover has a front end a rear end and, when at its closed position, substantially cover the toilet seat. The toilet seat assembly comprises a liquid discharge and disperse means, which further comprises one or more liquid discharge apertures for discharging a liquid, and one or more gas discharge apertures for facilitating dispersal of the liquid (e.g., sanitizing mist injection) in desired direction(s) (e.g., from to the rear end to the front end, from top to bottom, and/or other directions), thereby enabling the liquid to contact, clean, disinfect, sterilize, and/or sanitize the toilet seat (e.g., all areas of the toilet seat) and/or the toilet bowl.

In some embodiments, the liquid discharge and disperse means comprises an atomizer, a nebulizer, a vaporizer, an electrostatic sprayer, or any other suitable type of sprayer or injector.

In some embodiments, the liquid is discharged in a form of mist.

In some embodiments, the liquid discharge and disperse means comprises at least one atomizer for spraying the mist from the one or more liquid discharge apertures (e.g., in any desired direction).

In some embodiments, at least one atomizer is an ultrasonic mist atomizer (also called ultrasonic mist maker or humidifier). In some embodiments, the ultrasonic mist atomizer may include a piezo atomizer transducer for transporting high-frequency sound waves into a mechanical energy that is transferred into the liquid, thereby creating the mist. For instance, the ultrasonic mist atomizer may include a piezo atomizer transducer such as disc/nozzle (ceramic humidifier), which works by transposing high-frequency sound waves into mechanical energy that is transferred into a liquid, creating standing waves. As the liquid exits the atomizing surface of the disc, it's broken into a fine mist of uniform micron-sized droplets.

In some embodiments, the mist is discharged in one or more directions. The mist can be discharged from any direction. Examples of such directions may include but are not limited to: from the rear to front, and/or from top to bottom.

In some embodiments, at least part of the liquid discharge and disperse means is located at or close to the base, the cover or toilet seat.

In some embodiments, the liquid discharge and disperse means comprises one or more liquid or gas discharge apertures configured for discharging or facilitating dispersal of the liquid from behind the cover, from the cover, from the toilet seat, and/or from the base.

In some embodiments, the base can be short or long. For instance, the base can be extended (e.g., optionally with an extension) to encompass or over at least part or even the entirety of the toilet bowl. The liquid (e.g., mist) may be injected from the base (or its extension).

In some embodiments, the liquid discharge and disperse means optionally may include one or more fans for dispersing and inducing the mist.

In some embodiments, the gas is discharged at a predetermined time after the discharge of liquid.

In some embodiments, the toilet seat assembly includes a deodorizing substance (e.g., deodorizing oil), which can be either included by the liquid, or sprayed by a deodorizing spray (e.g., located below the toilet cover or toilet seat) into the toilet bowl (e.g., in any suitable direction).

In some embodiments, the toilet seat assembly comprises an electrical system operably configured to control the discharge and dispersal of liquid or deodorizing substance (e.g., deodorizing oil), and/or movement of the cover between open and closed positions.

In some embodiments, at least one (or both) of the cover and the toilet seat is removably attached to the base.

In some embodiments, the base is a universal design capable of fitting or being mounted onto a variety/all types of toilet structures, and capable of removably receiving and attaching different types, sizes, or shapes of cover and/or toilet seat (e.g., both U-shaped and circular toilet seats), thereby being able to adapt to different toilet bowl/seat designs.

In some embodiments, the base comprises the electrical system, at least part of the liquid discharge and disperse means, and/or a liquid storage unit.

In some embodiments, the toilet seat assembly further comprises a flushing control mechanism to ensure that the cover is closed when the toilet is flushed, in order to prevent undesired spread of germs. Such flushing control mechanism may be configured to control the movement of the cover by an electrical means, mechanical means, or combination thereof.

In some embodiments, the toilet seat assembly further comprises a wireless or wired communication system configured to collect data and/or inform status.

In some embodiments, the toilet seat assembly comprises a digital display configured to display the status and/or process of the cleaning, disinfecting, sterilizing, and/or sanitizing of the toilet seat, battery life, amount of disinfectant, and/or errors.

In some embodiments, the toilet seat assembly comprises a triggering mechanism configured for triggering the cleaning, disinfecting, sterilizing, and/or sanitizing procedure by a user. Such a triggering mechanism may include a mechanical means, electrical means, or a combination thereof. For instance, the triggering mechanism may include a sensor (e.g., IR sensor) for triggering the cleaning, disinfecting, sterilizing, and/or sanitizing procedure.

In some embodiments, the cover further comprises an upper wall; an outer sidewall extending downwardly from the edge of the upper wall; and an inner sidewall extending downwardly from bottom surface of the upper wall, wherein the outer and inner sidewalls at least partly oppose one another, and form part of a transport conduit configured to facilitate the dispersal of the liquid along the transport conduit.

In some alternative embodiments, the cover comprises an upper wall and optionally an outer sidewall extending downwardly from the edge of the upper wall, wherein the upper wall has a substantially flat bottom surface (e.g., without inner sidewall or conduit surrounding the inside perimeter of the toilet seat).

In some embodiments, the toilet seat assembly includes one or more of the following additional components: UVC disinfection light, solar panel for extension of battery life, medical testing device, dynamo on the water line to generate battery charge, bidet, seat warmer, night light, radio/music device, advertising, mini projector, air dryer for the seat and/or the user, AI system, voice command unit, user customization or memory settings, adjustable children seat, automatic seat closing and flushing control, massage device, remote control means, men kick and flush means, dual filtration, touch-free flush means, anti-stick surface, antimicrobial surface, fire retardant materials, UVC disinfection, Wi-Fi connectivity, Bluetooth connectivity or other wireless communication means, odor mitigation unit, unit for adjusting toilet height, and safety unit.

In some embodiments, the medical testing device is configured to conduct one or more medical studies. Examples of the medical applications or studies may include but are not limited to urine tests, dermatology, stool tests, weight measurements, blood pressure tests, and diabetes tests.

In some embodiments, the safe unit is configured to provide one or more the following functions: waterproof and moisture proof, fire protection, leak protection, over current protection, antifreeze protection, and short circuit protection.

In some embodiments, the toilet seat assembly is operated by one or more energy sources selected from the group consisting of batter power, kinetic energy, solar energy, mechanical energy, energy created by biodegradation, electric energy, recyclable or green energy, and smart power/energy saving means.

Another aspect of the present invention provides use of an atomizer (e.g., ultrasonic mist atomizer or other types of atomizers) in a delivery system for disinfecting a surface, wherein the surface remains substantially dry after getting a disinfection by the atomizer. This is significantly different from conventional sprays for disinfecting a surface (which result in wet surface after the disinfection)—and thus provides advanced features and convenience.

In some embodiments, the surface comprises a hard surface in the bathroom or kitchen, such as in a sink or toilet.

In some embodiments, the delivery system is included by a toilet seat assembly, such as the toilet seat assembly described above.

As used herein, the term "clean" or "cleaning" refers to a process to facilitate or aid in soil removal, bleaching, microbial population reduction, and any combination thereof.

As used herein, the term "sanitize" or "sanitizing" refers to reductions in microbial activity on a surface. A sanitizing process may include at least partially reducing the number of microorganisms as well as substantially reducing the number of microorganisms. In some embodiments, sanitization includes sterilization, e.g., where all microorganisms or all desired microorganisms are destroyed. As used herein, the term "microorganism" refers to any noncellular or unicellular (including colonial) organism. Microorganisms include all prokaryotes. Microorganisms include bacteria (including cyanobacteria), spores, lichens, fungi, protozoa, virinos, viroids, viruses, phages, and some algae.

As used herein, the term "or" is meant to include both "and" and "or." In other words, the term "or" may also be replaced with "and/or."

As used herein, the singular forms "a," "an" and "the" are intended to include the plural forms as well, unless the context clearly indicates otherwise.

As used herein, the spatially relative terms, such as "top", "bottom", "inside", "outside", "above", and "under" may be used herein for ease of description to describe one element or feature's relationship to another element(s) or feature(s) as illustrated in the figures. Similarly, the terms "vertical" and "horizontal" and the like are used for the purpose of explanation only unless specifically indicated. The terms are not intended to require the described elements or structures in a specific direction, and are not intended to limit the scope of this invention as such.

BRIEF DESCRIPTIONS OF THE FIGURES

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers.

FIG. 1 provides a front view of an exemplary toilet seat assembly, with its cover at the closed position, according to one embodiment of the present invention.

Figure 2:
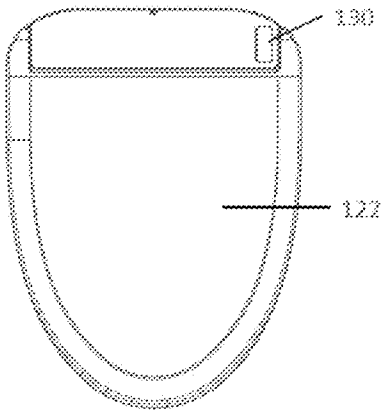

FIG. 2 provides a top view of the toilet seat assembly in FIG. 1, with its cover at the closed position.

Figure 3:
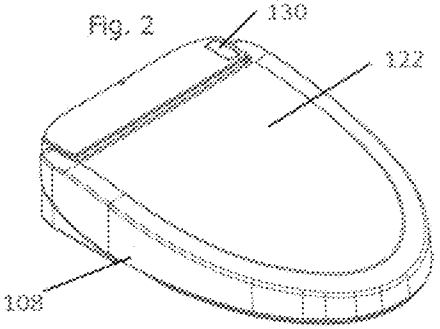

FIG. 3 provides a perspective view of the toilet seat assembly in FIG. 1, with its cover at the closed position.

Figure 4:
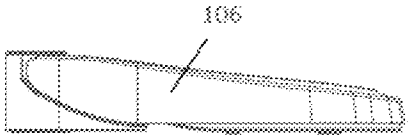

FIG. 4 provides a side view of the toilet seat assembly in FIG. 1, with its cover at the closed position.

Figure 5:
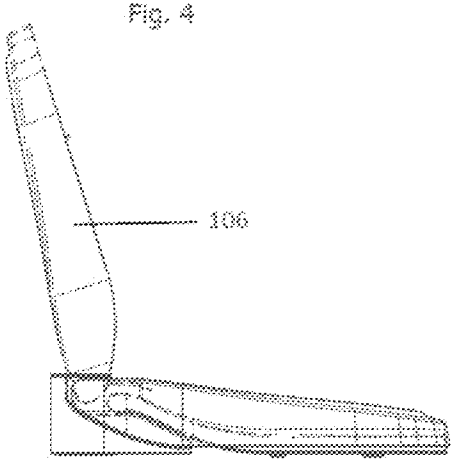

FIG. 5 provide another side view of the toilet seat assembly in FIG. 1, with its cover at the open position.

Figure 6:
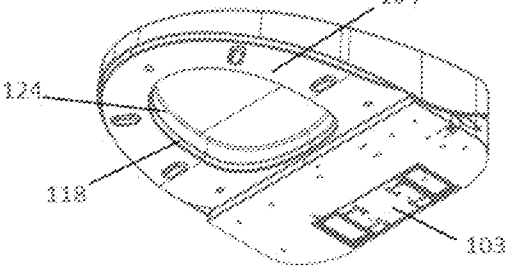

FIG. 6 provides another perspective view of the toilet seat assembly in FIG. 1, with its cover at the closed position.

Figure 7:
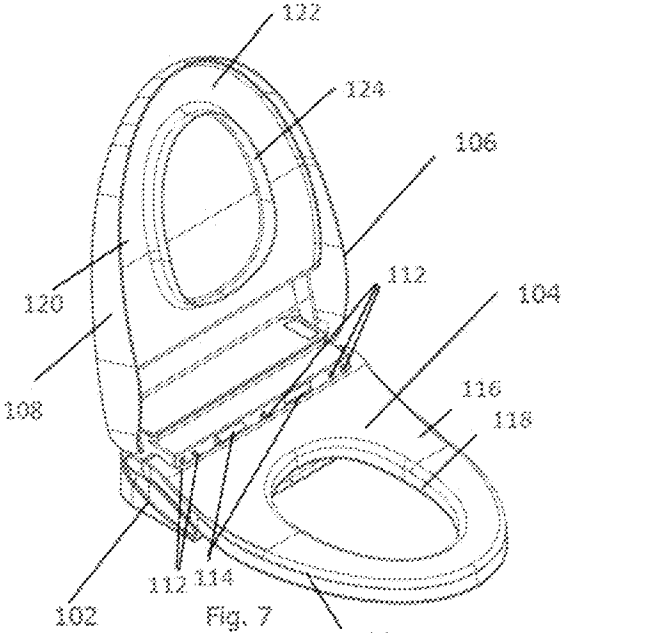

FIG. 7 provides another perspective view of the toilet seat assembly in FIG. 1, with its cover at the open position.

Figure 8:
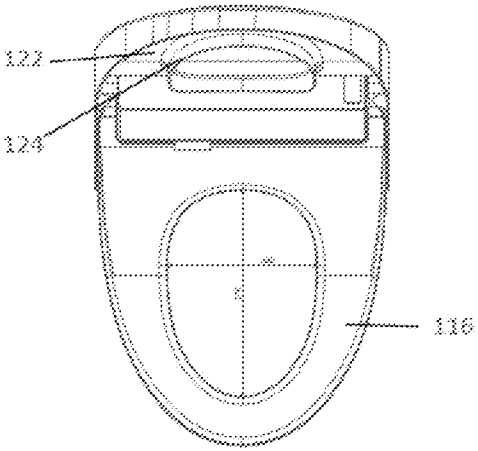

FIG. 8 provides another top view of the toilet seat assembly in FIG. 1, with its cover at the open position.

Figure 9:
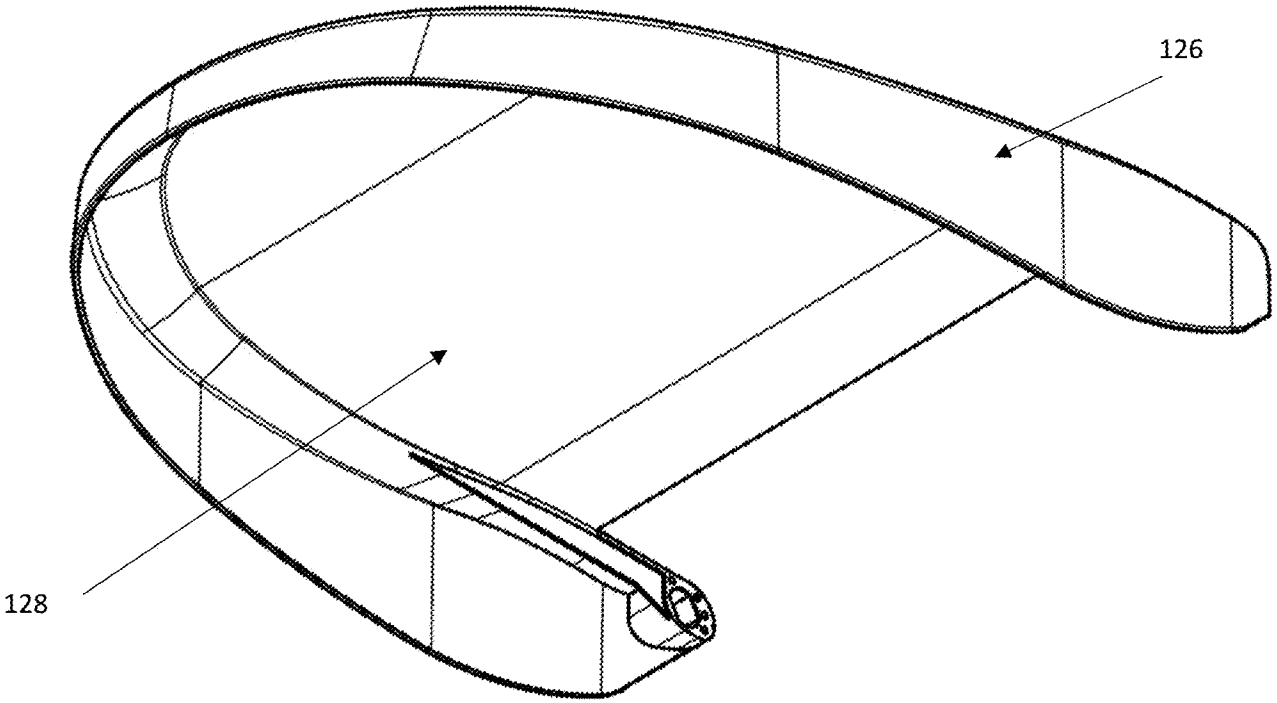

FIG. 9 provides a perspective view of a cover according to one embodiment of the present invention.

Figure 10:
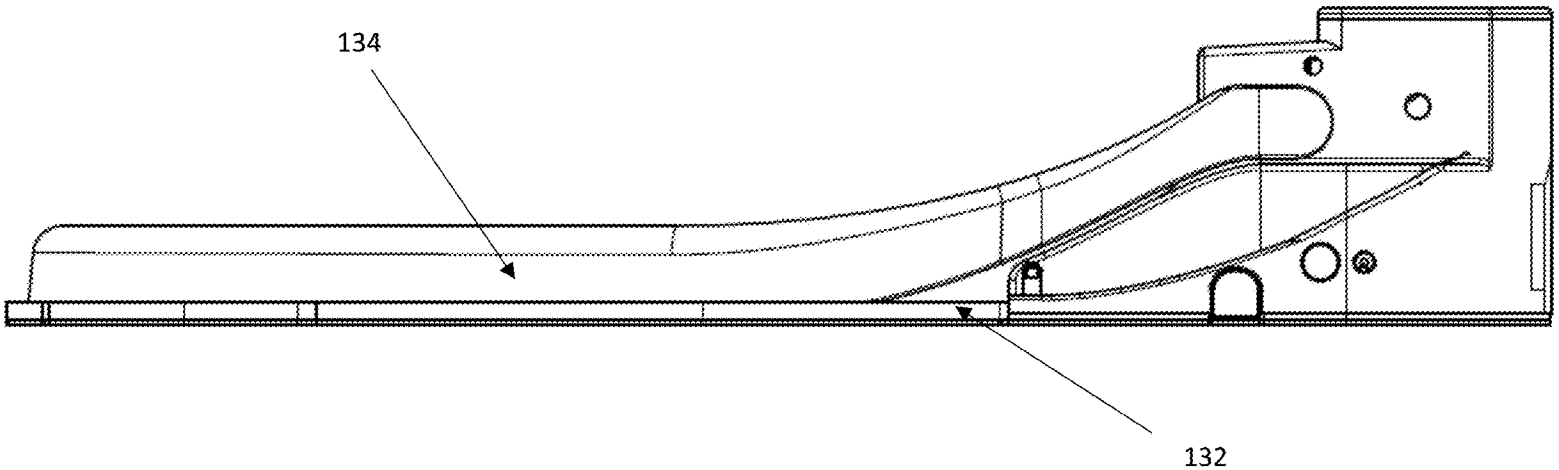

FIG. 10 provides a side view of a base with an attached toilet seat, according to one embodiment of the present invention.

Figure 11:
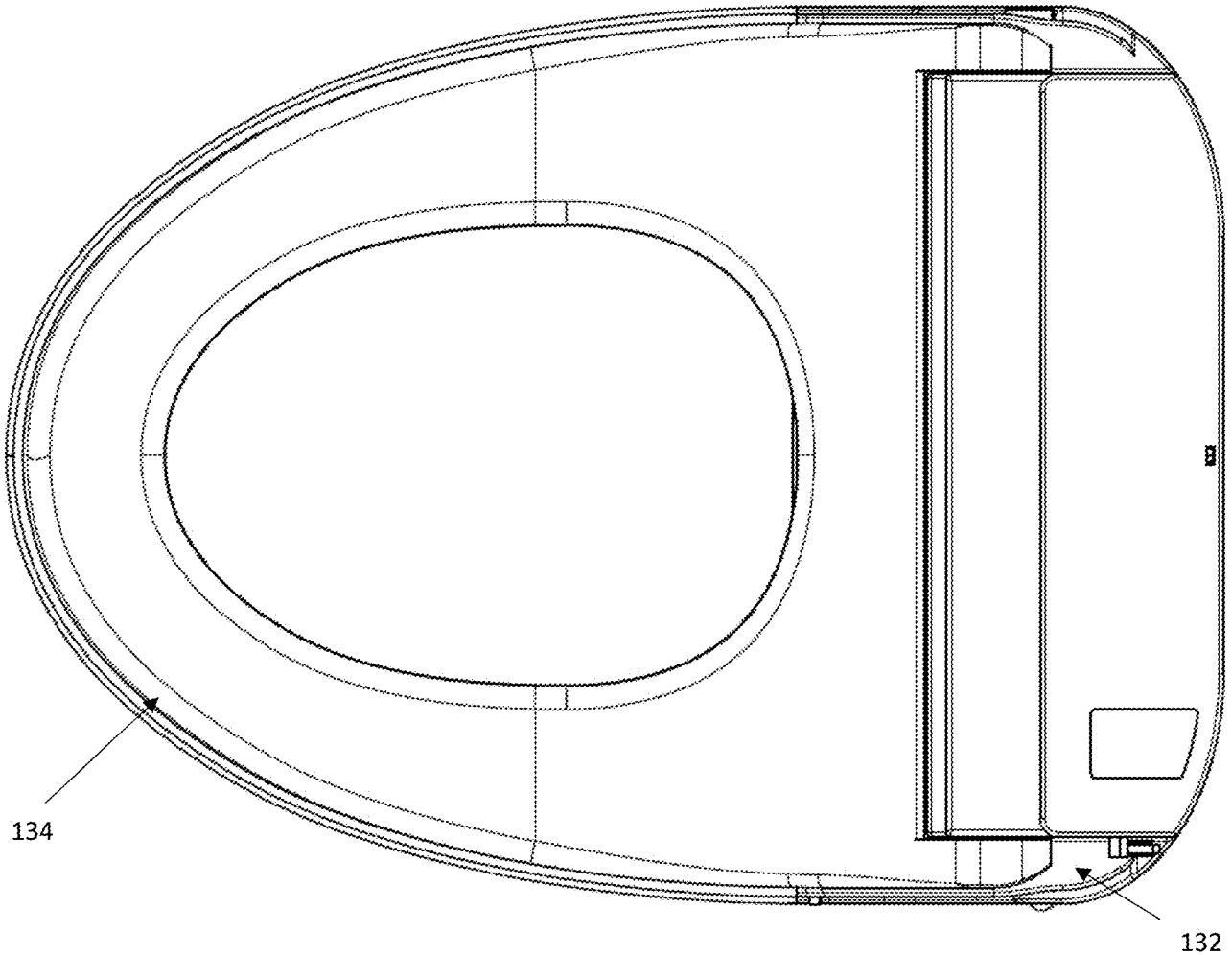

FIG. 11 provides a top view of the base with the attached toilet seat in FIG. 10.

Figure 12:
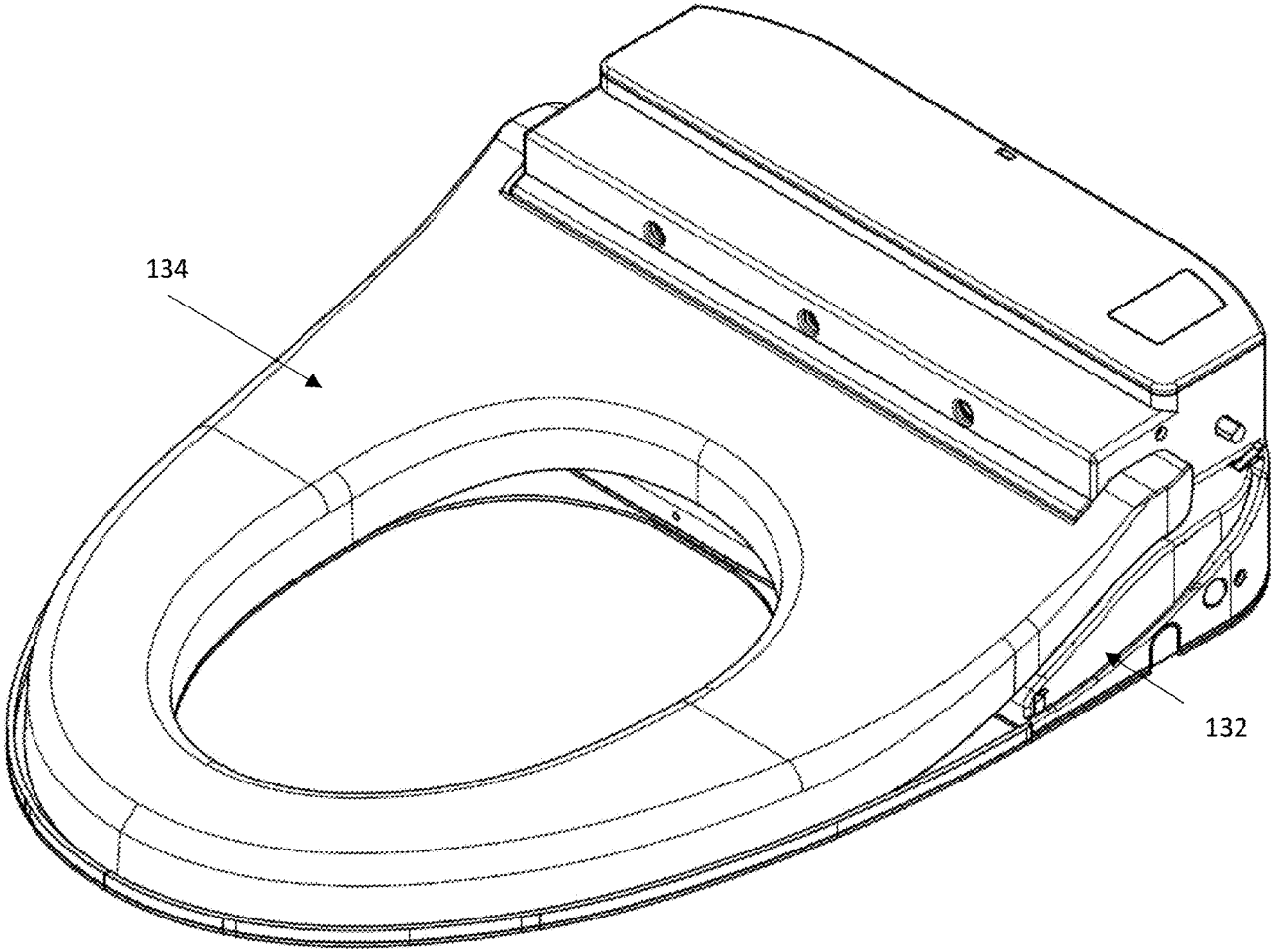

FIG. 12 provides a perspective view of the base with the attached toilet seat in FIG. 10.

Figure 13:
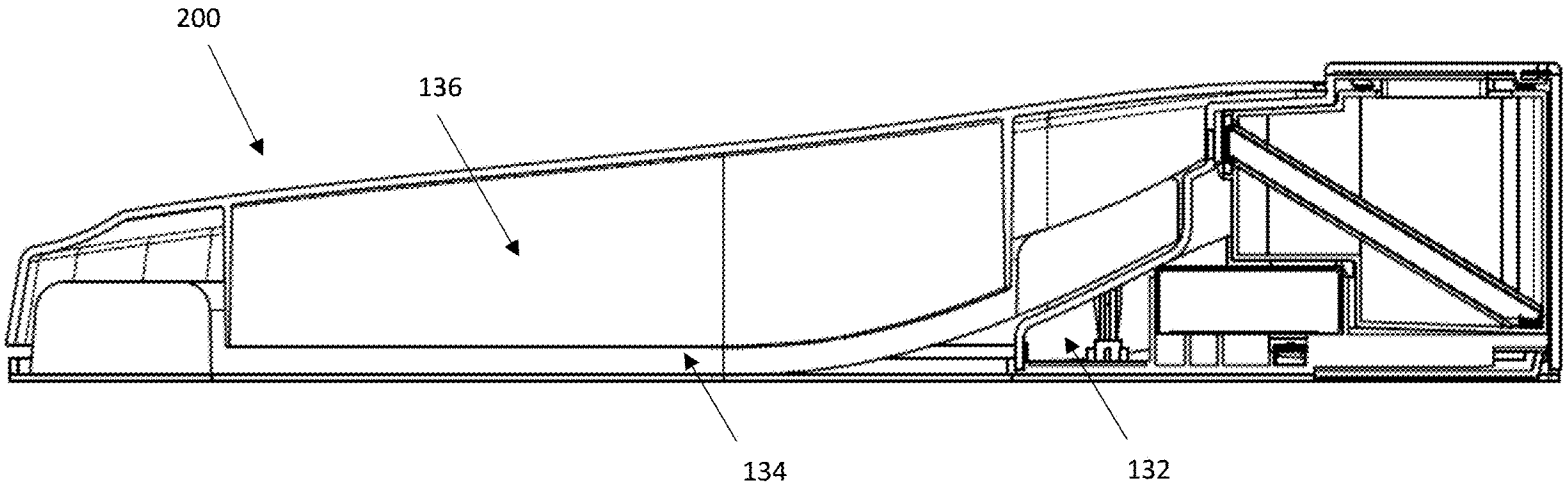

FIG. 13 provides a side cross-sectional view of a base with attached toilet seat and cover at the closed position, according to one embodiment of the present invention.

Figure 14:
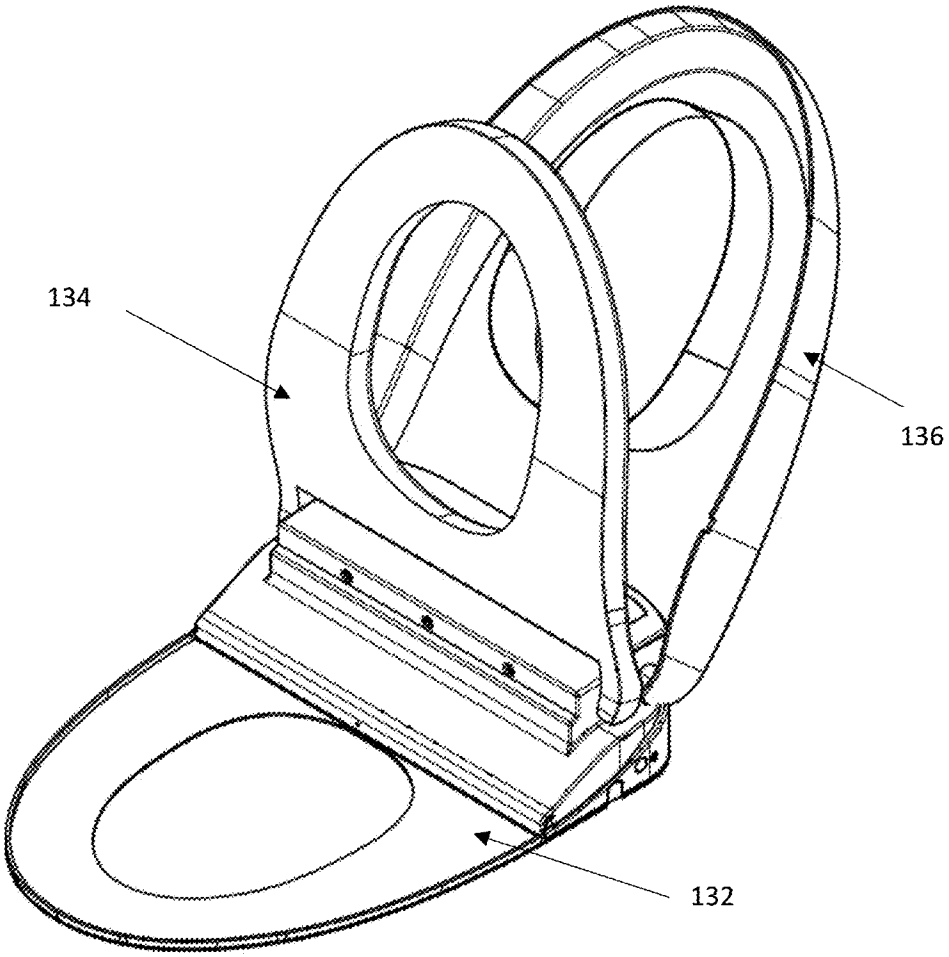

FIG. 14 provides a perspective view of the base in FIG. 13, with attached toilet seat and cover at the open position.

Figure 15:
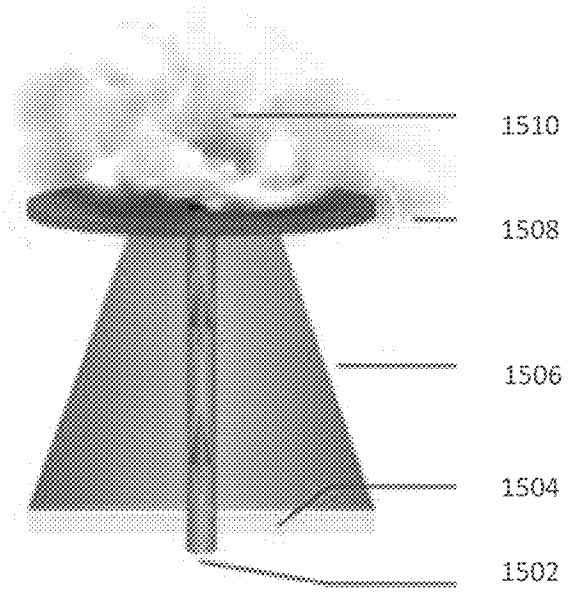

FIG. 15 illustrates an exemplary ultrasonic atomizer included by a toilet seat assembly according to some embodiments of the present invention.

Figure 16B:
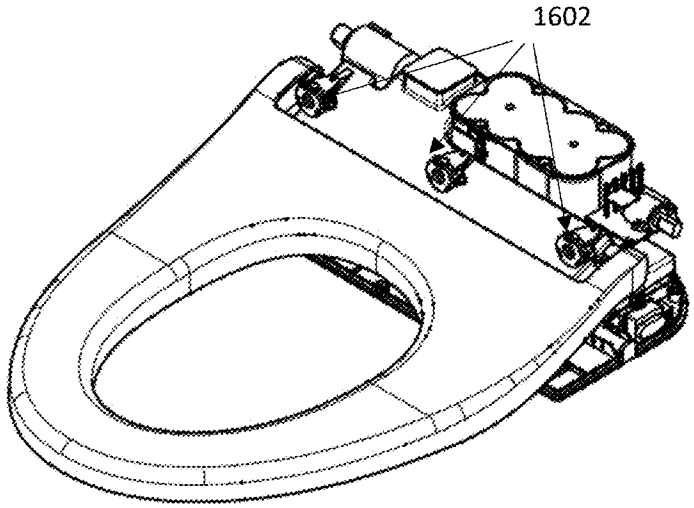
Figure 16A:
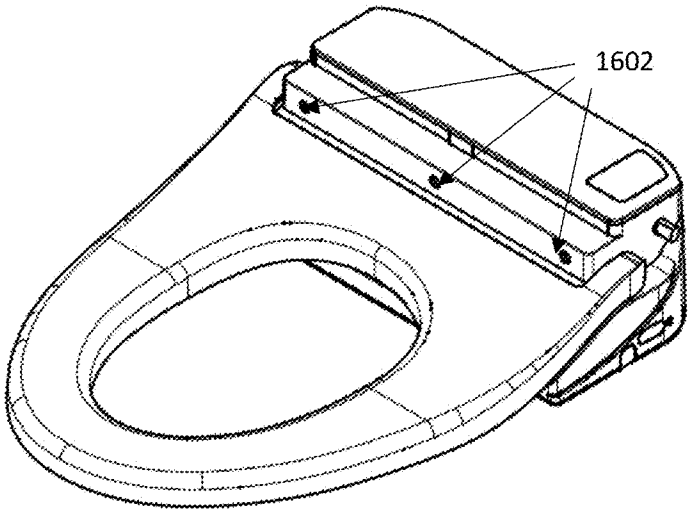

FIG. 16A provides a perspective view of an exemplary toilet assembly according to one embodiment of the present invention including three atomizers.

FIG. 16B provides a partially exposed perspective review of the toilet assembly in FIG. 16A.

Figure 17:
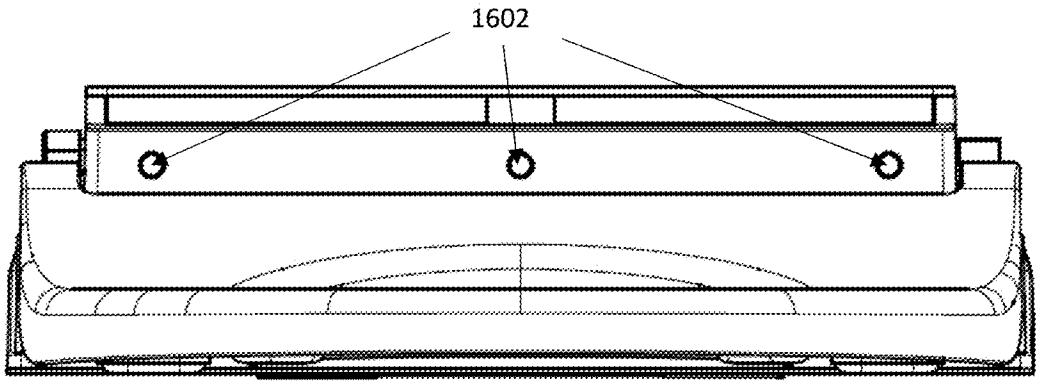

FIG. 17 provides a front review of toilet seat assembly in FIG. 16A.

Figure 18A:
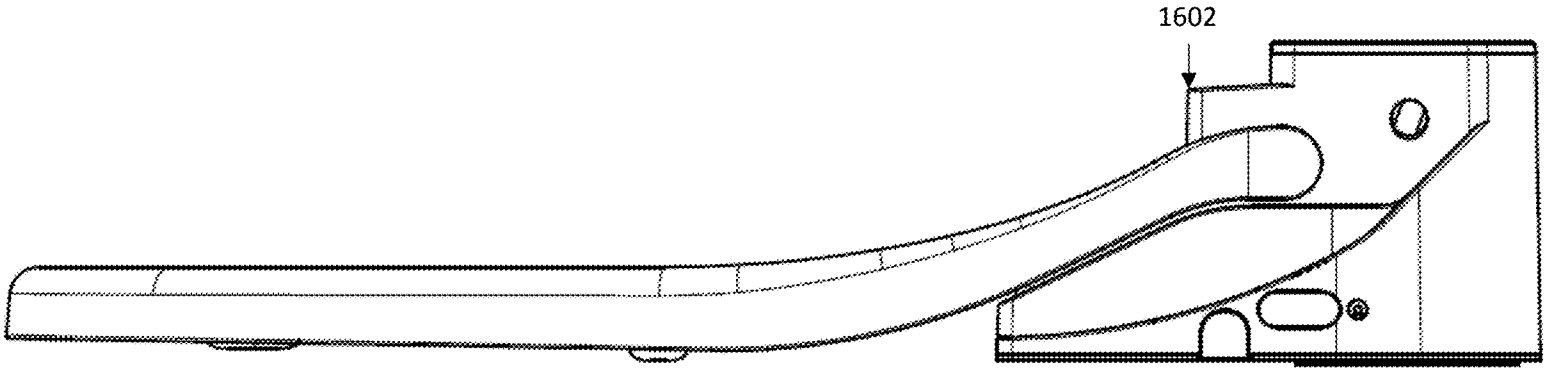

FIG. 18A provides a side review of the toilet assembly in FIG. 16A.

Figure 18B:
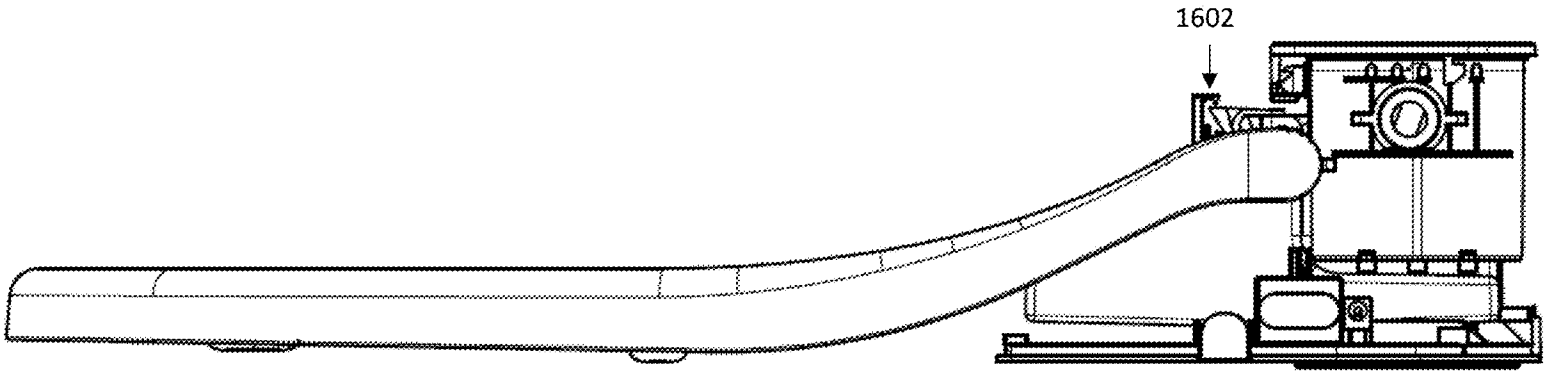

FIG. 18B provides a partially exposed side review of the toilet assembly in FIG. 18A.

DETAILED DESCRIPTION OF THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. To the contrary, the invention is intended to cover alternatives, modifications and equivalents, which may be included within the spirit and scope of the invention as defined by the claims. Furthermore, in the detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and other features have not been described in detail as not to unnecessarily obscure aspects of the present toilet seat assembly.

Generally speaking, various embodiments of the present invention provide for an improved toilet seat assembly capable of automatically, effectively and efficiently cleaning, disinfecting, sterilizing, and/or sanitizing toilet seats. Set forth below are several illustrations or examples of apparatus of this invention containing toilet seat assembly.

Referring now to FIGS. 1-9 and utilizing the incorporated disclosure referenced above, one embodiment of the present invention is shown. FIGS. 1-9 show several advantageous features of the present invention, but, as will be described below, the invention can be provided in several shapes, sizes, combinations of features and components, and varying numbers and functions of the components.

FIGS. 1-8 shows toilet seat assembly 100 which includes base 102 to be secured to the top surface of the toilet bowl (e.g., through a securing and attaching assembly 103 as shown in FIG. 6). Toilet seat 104 and cover 106 are attached (e.g., pivotally) to base 102. The toilet seat 104 and/or cover 106 can be removably attached to the base. For instance, the base 102 may be a universal design/module capable of fitting or being mounted onto a variety types of toilet structures, and capable of removably receiving and attaching different types, sizes, or shapes of cover and/or toilet seat (e.g., both U-shaped and circular toilet seats). Both the toilet seat 104 and the cover 106 are movable/rotatable between their respective open and closed positions (e.g., as shown in FIGS. 6, 8, and 9, which illustrate the toilet seat assembly with its cover opened). When the cover 106 is closed, it substantially covers the toilet seat 104 (e.g., with the outer sidewall 108 of the cover substantially surrounding, contouring and/or adjoining the outer circumference surface 110 of the toilet seat). The toilet seat assembly according to the present invention may also include a flushing control mechanism to ensure that the cover is put down or completely closed when the toilet is flushed, in order to prevent undesired spread of germs, e.g., by electrical means, mechanical or other means.

As shown in FIGS. 1 and 8, toilet seat assembly 100 may include one or more liquid discharge apertures 112 for discharging a liquid (e.g., with sprayer or atomizer configured for spraying a mist), and one or more gas discharge apertures 114 (e.g., optionally with fans) for facilitating dispersal of the liquid, generally in a direction from to the rear end to the front end. Accordingly, the liquid is dispersed throughout the toilet seat 104 (e.g., all areas of the toilet seat 104 including its top surface 116, inner circumference surface 118 and outer circumference surface 110), as well as the toilet bowl area, thereby cleaning, disinfecting, sterilizing, and/or sanitizing the toilet seat and toilet bowl. Particularly, there may be one or multiple discharge apertures (or entries), configured for discharging or facilitating dispersal of the liquid from the same or different locations (e.g., behind the cover, from the cover, from the toilet seat, and/or from the base). The liquid discharge according to the present invention may be atomized liquid spray of water, disinfectant, a combination of water and/or disinfectant, or other liquid. It is also to be understood that, according to the present invention, the liquid (e.g., sanitizing mist) may be discharged in any other desired direction(s), including, e.g., from top to bottom.

In some embodiments, the cover 106 is designed to form a transport conduit 120 to facilitate the dispersal of the liquid along the transport conduit. For instance, as shown in FIGS. 8 and 9, the cover 106 may include an upper wall 122; an outer sidewall 108 extending downwardly from the edge of the upper wall; and an inner sidewall 124 extending downwardly from bottom surface of the upper wall. The outer and inner sidewalls at least partly oppose one another. When the cover is closed, the outer sidewall of the cover is configured for substantially surrounding, contouring and/or adjoining the outer circumference surface of the toilet seat. In some embodiments, the inner sidewall 124 of the cover is shaped corresponding to (but smaller than) the inner circumference surface of the toilet seat. For instance, when the cover is closed, the inner sidewall 124 of the cover may be located in proximity to and generally surrounded by the inner circumference surface 118 of the toilet seat. Accordingly, part of the upper wall 122, the outer and inner sidewalls (108, 124) of the cover, and a portion of the toilet seat form a transport conduit, along which liquid and/or gas are guided to flow as desired, thereby ensuring that important parts of the toilet seat are effectively reached and cleaned.

In some other embodiments, the bottom surface of the upper wall of the cover can be generally flat (like the conventional toilet seat covers). For instance, as shown in FIG. 9, cover 126 can have a generally flat bottom/inner surface 128 for its upper wall, without any inner sidewall (or conduit) surrounding the inside perimeter of the toilet seat.

The toilet seat assembly may include an electrical system to control the discharge and dispersal function, the cleaning, disinfecting, sterilizing, and/or sanitizing process, and the movement of the cover. In some embodiments, the electrical system is located in a universal base, which removably receives the attached toilet seat and cover. Accordingly, a user can easily change or replace the toilet seat and cover that are attached to the base, in order to adapt the base (as well as its electrical system and liquid discharge and disperse system) to different toilet seat/bowl designs as desired.

The toilet seat assembly according to the present invention may also include a wireless or wired communication system configured to collect data and/or inform status (e.g., status and/or process of the cleaning, disinfecting, sterilizing, and/or sanitizing of the toilet seat, battery life, amount of disinfectant, and/or errors). Moreover, the toilet seat assembly according to the present invention may include additional components, such as a deodorizing spray for spraying a deodorizing substance (e.g., deodorizing oil) into the toilet bowl, UVC disinfection light, solar panel for extension of battery life, medical testing device, dynamo on the water line to generate battery charge, bidet, seat warmer, night light, radio/music device, advertising, mini projector, air dryer for the seat and/or the user, AI system, voice command unit, user customization or memory settings, adjustable children seat, automatic seat closing and flushing control, massage device, remote control means, men kick and flush means, dual filtration, touch-free flush means, anti-stick surface, antimicrobial surface, fire retardant materials, UVC disinfection, Wi-Fi connectivity, Bluetooth connectivity or other wireless communication means, odor mitigation unit, unit for adjusting toilet height, and/or safety unit. For instance, medical testing device may conduct one or more medical studies, examples of which include but are not limited to urine tests, dermatology, stool tests, weight measurements, blood pressure tests, and diabetes tests. The safe unit may provide safety protections, such as waterproof and moisture proof, fire protection, leak protection, over current protection, antifreeze protection, and/or short circuit protection. Further, examples of energy source for the toilet seat assembly may include but are not limited to: batter power, kinetic energy, solar energy, mechanical energy, energy created by biodegradation, electric energy, recyclable or green energy, and smart power/energy saving means.

Further, as shown in, e.g., FIGS. 2 and 3, the toilet seat assembly according to the present invention may include a triggering mechanism 130 configured for triggering the automatic cleaning, disinfecting, sterilizing, and/or sanitizing procedure by a user, and/or assisting the medical unit to conduct medical studies. Such a triggering mechanism 130 may be electrical and/or mechanical. For instance, the triggering mechanism may include a sensor (e.g., IR sensor). Moreover, a digital display (via wireless or wired communications) may be included to display the status or information, such as status and/or process of the cleaning, disinfecting, sterilizing, and/or sanitizing of the toilet seat, battery life, amount of disinfectant, and/or errors.

For instance, when the cover is open and when a "Ready" light is turned on in the digital display, the user may initiate the cleaning, disinfecting, sterilizing, and/or sanitizing cycle or use the seat directly. To initiate the cleaning process, the user may trigger a triggering mechanism (e.g., an IR sensor), upon which the cover automatically closes, and a "Sanitizing" light in the digital display turns on to indicate the ongoing sanitizing or cleaning process. Once the cover is closed, the atomizer(s) spray a mist (e.g., for 7 seconds). After the atomizer(s) turn off, there may be a period of no action (e.g., for 5 seconds), and then optionally dispensing means (e.g., fans) turns on (e.g., for 5 seconds) to disperse the mist along the transport conduit formed by the closed cover and the toilet seat surface. After the cleaning, disinfecting, sterilizing, and/or sanitizing process, the cover is automatically raised, and the "Ready" light is turned on again in the digital display. In some embodiments, a deodorizing substance (e.g., deodorizing oil) may also be sprayed into the toilet bowl some time (e.g., 10 seconds) after the user sits down.

Still in some embodiments, the base can be short or long. For instance, the base can be extended (e.g., optionally with an extension) to encompass or over at least part or even the entirety of the toilet bowl. The liquid (e.g., mist) may be injected from the base (or its extension). FIGS. 10-12 illustrate extended/long base 132 with an attached toilet seat 134. FIGS. 13-14 further illustrate an exemplary toilet seat assembly 200 including extended/long base 132, toilet seat 134, and cover 136. As shown in FIGS. 10-14, the base 132 (with central hole 138) may extend over the entire toilet bowl, e.g., below the toilet seat 134. As described herein, it is to be understood that different types and shapes of toilet seats and covers (e.g., with or without a transport conduit) can be attached to the base 132 to constitute a toilet seat assembly according to the present invention.

In some embodiments, at least one atomizer included by a toilet seat assembly according to the present invention may be an ultrasonic mist atomizer. FIG. 15 shows the general principal of an exemplary ultrasonic atomizer. As shown in FIG. 15, the ultrasonic mist atomizer may include piezo atomizer transducer 1504 (e.g., piezoelectric ceramic plate mounted under a conal case 1506), which works by transposing high-frequency sound waves into mechanical energy. As such, the generation of capillary waves is driven by the piezoelectric ceramic plate. Depending on the application, the liquid is transported from liquid injection 1502, and then to ultrasonic vibrating surface 1508, which is set into vibration by the oscillating piezo element. As the liquid exits the atomizing surface of the plate, it's broken into a fine mist of uniform micron-sized droplets, and thus aerosol (mist) 1510 is thereby emitted. For such an exemplary ultrasonic mist atomizer, the frequency may range from about 20 kHz to about 500 kHz. The typical mass median aerodynamic diameter (MMAD) with atomization of water at 100 kHz may be approximately 30 μm; and the typical atomization rate may be up to 0.5 l/h.

The present invention also relates to use of an atomizer in a delivery system for disinfecting a surface in general. According to the present invention, the surface (e.g., in a toilet or a sink) remains substantially dry after getting a disinfection by the atomizer. This is significantly different from conventional sprays for disinfecting a surface, which result in wet surface after the disinfection. As such, use of atomizer (e.g., ultrasonic mist atomizer or other types of atomizers) in a delivery system provides advanced features and convenience for cleaning a surface. FIGS. 16A-B, 17, and 18A-B further illustrate use of atomizers, e.g., in a toilet seat assembly. FIG. 16A shows the perspective review of a toilet seat assembly including three atomizers 1602. FIG. 16B further illustrates an exposed perspective review of atomizers 1602. FIG. 17 provides a front review of the toilet seat assembly with atomizers 1602. Moreover, FIG. 18A provides a side review of the toilet assembly, and FIG. 18B further illustrates an exposed side review showing atomizers 1602.

Although specific embodiments of this invention have been illustrated herein, it will be appreciated by those skilled in the art that any modifications and variations can be made without departing from the spirit of the invention. The examples and illustrations above are not intended to limit the scope of this invention. Any combination of embodiments of this invention, along with any obvious their extension or analogs, are within the scope of this invention. Further, it is intended that this invention encompass any arrangement, which is calculated to achieve that same purpose, and all such variations and modifications as fall within the scope of the appended claims.

All the features disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example of a generic series of equivalent or similar features.

Other Embodiments

It is to be understood that while the invention has been described in conjunction with the detailed description thereof and accompanying figures, the foregoing description and accompanying figures are only intended to illustrate, and not limit the scope of the invention, which is defined by the scope of the appended claims. Other aspects, advantages, and modifications are within the scope of the following claims. All publications referenced herein are incorporated by reference in their entireties.

What is claimed is:

1. A toilet seat assembly for a toilet having a toilet bowl with a top surface, the toilet seat assembly comprising:

a base configured to be secured to the top surface of the toilet bowl;

a toilet seat attached to the base and movable between an open position and a closed position; and a cover attached to the base and movable between an open position and a closed position, wherein the cover has a front end and a rear end and, when at its closed position, substantially covers the toilet seat; and a liquid discharge and disperse means, said liquid discharge and disperse means comprising a plurality of liquid discharge apertures for discharging a liquid, and one or more gas discharge apertures for facilitating dispersal of the liquid, thereby enabling the liquid to contact, clean, disinfect, sterilize and/or sanitize the toilet seat and toilet bowl;

wherein the plurality of liquid discharge apertures are positioned above a top surface of the toilet seat, when the toilet seat is in the closed position; and wherein the liquid discharge and disperse means comprises an ultrasonic mist atomizer configured to operate at a frequency from 20 kHz to 500 kHz.

2. The toilet seat assembly of claim 1, wherein the ultrasonic mist atomizer comprises a piezoelectric atomizer transducer for transporting high-frequency sound waves into a mechanical energy that is transferred into the liquid, thereby creating the mist.

3. The toilet seat assembly of claim 1, wherein at least part of the liquid discharge and disperse means is located at or close to the base, the cover or toilet seat.

4. The toilet seat assembly of claim 1, wherein the liquid discharge and disperse means comprises one or more liquid or gas discharge apertures configured for discharging or facilitating dispersal of the liquid from behind the cover, from the cover, from the toilet seat, or from the base.

5. The toilet seat assembly of claim 1, wherein the base is extended to encompass at least part of or the entirety of the toilet bowl.

6. The toilet seat assembly of claim 1, wherein the gas is discharged at a predetermined time after the discharge of liquid.

7. The toilet seat assembly of claim 1, further comprising a deodorizing substance that is included by the liquid or is sprayed by a separate deodorizing spray into the toilet bowl.

8. The toilet seat assembly of claim 1, further comprising a wireless or wired communication system configured to collect data or inform status.

9. The toilet seat assembly of claim 1, wherein the cover further comprises an upper wall; an outer sidewall extending downwardly from an edge of the upper wall; and an inner sidewall extending downwardly from a bottom surface of the upper wall, wherein the outer and inner sidewalls at least partly oppose one another, and form part of a transport conduit configured to facilitate the dispersal of the liquid along the transport conduit.

10. The toilet seat assembly of claim 1, wherein the cover comprises an upper wall and optionally an outer sidewall extending downwardly from the edge of the upper wall, wherein the upper wall has a substantially flat bottom.

11. The toilet seat assembly of claim 1, further comprising one or more of the following components: UVC disinfection light, solar panel for extension of battery life, dynamo on a water line to generate battery charge, bidet, seat warmer, night light, radio/music device, advertising, mini projector, air dryer for the seat or the user, AI system, voice command unit, user customization or memory settings, adjustable children seat, automatic seat closing and flushing control, massage device, remote control means, men kick and flush means, dual filtration, touch-free flush means, anti-stick surface, antimicrobial surface, fire retardant materials, UVC disinfection, Wi-Fi connectivity, Bluetooth connectivity or other wireless communication means, odor mitigation unit, and unit for adjusting toilet height.

12. The toilet seat assembly of claim 1, further comprising one or more energy sources selected from the group consisting of battery power, kinetic energy, solar energy, mechanical energy, energy created by biodegradation, electric energy, and recyclable or green energy.

13. The toilet seat assembly of claim 1, wherein one or more of the liquid discharge apertures are positioned on the base.

14. The toilet seat assembly of claim 1, wherein the ultrasonic mist atomizer comprises:

a piezo atomizer transducer comprising a piezoelectric ceramic plate mounted under a conal case;

an ultrasonic vibrating surface, wherein the conal case is positioned between the piezoelectric ceramic plate and the ultrasonic vibrating surface; and a liquid injector.

15. The toilet seat assembly of claim 1, wherein the liquid discharge and disperse means comprises an ultrasonic mist atomizer for each of the plurality of liquid discharge apertures.

16. The toilet seat assembly of claim 1, wherein the liquid discharge and disperse means comprises a plurality of gas discharge apertures positioned above the top surface of the toilet seat, when the toilet seat is in the closed position.

17. The toilet seat assembly of claim 1, further comprising an electrical system operably configured to control the discharge and dispersal of liquid or deodorizing substance, or movement of the cover between open and closed positions.

18. The toilet seat assembly of claim 17, wherein the base comprises the electrical system, at least part of the liquid discharge and disperse means, or a liquid storage unit.

19. The toilet seat assembly of claim 1, wherein at least one of the cover and the toilet seat is removably attached to the base.

20. The toilet seat assembly of claim 19, wherein the base is a universal design capable of fitting or being mounted onto a variety types of toilet structures, and capable of removably receiving and attaching different types, sizes, or shapes of the cover or toilet seat.

21. The toilet seat assembly of claim 1, further comprising a triggering mechanism configured for triggering the cleaning, disinfecting, sterilizing, or sanitizing procedure by a user.

22. The toilet assembly of claim 21, wherein the triggering mechanism comprises an electrical means, mechanical means, or a combination thereof.

23. The toilet assembly of claim 22, wherein the triggering mechanism comprises a sensor.

24. The toilet seat assembly of claim 1, wherein the liquid is discharged in a form of mist.

25. The toilet seat assembly of claim 24, wherein the liquid discharge and disperse means comprises one or more fans for dispersing and inducing the mist.

26. The toilet seat assembly of claim 24, wherein the mist is discharged in one or more directions.

27. The toilet seat assembly of claim 26, wherein the direction comprises from the rear to front or from top to bottom.

28. A method for disinfecting a toilet seat of a toilet seat assembly, wherein:

the toilet seat assembly comprises:

a base configured to be secured to a top surface of a toilet bowl;

the toilet seat, wherein the toilet seat is attached to the base and movable between an open position and a closed position; and a cover attached to the base and movable between an open position and a closed position, wherein the cover has a front end and a rear end and, when at its closed position, substantially covers the toilet seat; and a liquid discharge and disperse means, said liquid discharge and disperse means comprising a plurality of liquid discharge apertures for discharging a liquid, and one or more gas discharge apertures for facilitating dispersal of the liquid, thereby enabling the liquid to contact, clean, disinfect, sterilize and/or sanitize the toilet seat and toilet bowl;

wherein the plurality of liquid discharge apertures are positioned above the top surface of the toilet seat, when the toilet seat is in the closed position; and wherein the liquid discharge and disperse means comprises an ultrasonic mist atomizer configured to operate at a frequency from 20 kHz to 500 kHz, and wherein the method comprises:

discharging the liquid from the plurality liquid discharge apertures; and discharging gas from the one or more gas apertures to facilitate dispersal of the liquid.

* * * * *